US012025400B1

(12) United States Patent
Liu

(10) Patent No.: US 12,025,400 B1
(45) Date of Patent: Jul. 2, 2024

(54) CONTINUOUS SHOOTING DEVICE WITH CONTROLLABLE ARROW CHAIN STRUCTURE

(71) Applicant: Chi-Chang Liu, Taichung (TW)

(72) Inventor: Chi-Chang Liu, Taichung (TW)

(73) Assignee: POE LANG ENTERPRISE CO., LTD.

( * ) Notice: Subject to any disclaimer, the term of this patent is extended or adjusted under 35 U.S.C. 154(b) by 0 days.

(21) Appl. No.: 18/204,955

(22) Filed: Jun. 2, 2023

(51) Int. Cl.
*F41B 5/12* (2006.01)
*F41A 9/29* (2006.01)
*F41A 9/32* (2006.01)

(52) U.S. Cl.
CPC ..... *F41B 5/126* (2013.01); *F41A 9/29* (2013.01); *F41A 9/32* (2013.01)

(58) Field of Classification Search
CPC ..... F41B 5/126; F41A 9/29; F41A 9/32
See application file for complete search history.

(56) References Cited

U.S. PATENT DOCUMENTS 2,417,080 A * 3/1947 Lochhead ..... F41A 9/32 89/33.2
2,453,977 A * 11/1948 Eames ..... F41A 9/32 74/130
3,221,603 A * 12/1965 Lochhead ..... F41A 9/32 89/33.2
2022/0107151 A1* 4/2022 Bennink ..... F41A 3/66
2022/0205749 A1* 6/2022 Franssen ..... F41A 9/32

* cited by examiner

*Primary Examiner* — John E Simms, Jr.

(57) ABSTRACT

A continuous shooting device includes a shooting body having a driving chamber and a chain hole in connection with the driving chamber, a belt chain assembly, an arrow driving assembly and a string firing assembly. The belt chain assembly is for driving the arrow chain, to move along the chain hole, the arrow driving assembly has a push arm for pushing an arrow on the arrow chain to escape from the arrow chain, a string of the string firing assembly is for pushing the belt chain assembly, a part of the driving assembly is mounted in the driving chamber, the driving assembly includes a track rod assembly fastened in the driving chamber, and a sliding member assembly slidable along an arrangement direction of the track rod assembly. The sliding member assembly has a carrying portion for clipping a string, and a pushing portion for pushing the push shaft.

10 Claims, 20 Drawing Sheets

CONTINUOUS SHOOTING DEVICE WITH CONTROLLABLE ARROW CHAIN STRUCTURE

BACKGROUND OF THE INVENTION

1. Field of the Invention

The present invention is related to a continuous shooting device with a controllable arrow chain structure, and particularly to the technology applied in the field of shooting.

2. Description of the Related Art

In the early shooting sports, bullet shooting devices have continuous shooting structures, such as magazines or bullet chains; for example, Taiwan new model patent No. M627524 discloses a bullet chain in a simulated bouncing chain structure of a toy gun. However, in the shooting sport of bows and arrows, the user must draw and mount bows and arrows one by one before shooting.

The shooting devices using bows and arrows do not have the above-mentioned bullet chain. Some manufactures developed new type of arrow boxes, for example, TW invention patent No. I738463 discloses a crossbow arrow loading device enabling a user to perform continuous shooting operations. However, compared with the bullet chain, the conventional arrow box has several shortcomings, first the number of shots is limited by a height of the arrow box, the number of bows and arrows that the arrow box can hold is limited, and the heavy arrow box loaded too many arrows also increases the user's burden on operation; secondly, the disassembly operation of the arrow box is too time-consuming, and it undoubtedly affects the user's concentration and stability in shooting.

SUMMARY OF THE INVENTION

An objective of the present invention is to increase the number of arrows and maintain the stability and accuracy of continuous shooting, and provide an operation that is more simple and easy to use, so that a user just needs to directly put an arrow chain with multiple arrows into the continuous shooting device and then starts shooting.

In order to achieve the objective, the present invention provides a continuous shooting device with a controllable arrow chain structure. The continuous shooting device includes a shooting body, a belt chain assembly, an arrow driving assembly, a string firing assembly, and a driving assembly. The shooting body has a driving chamber disposed therein, and a chain hole cut through a side of the shooting body to other side of the shooting body to connect the driving chamber. The belt chain assembly is disposed in the driving chamber, and includes a driving block configured to engage with an arrow chain, and a slider assembly configured to control movement of the driving block, wherein the driving block corresponds in position to the chain hole and is movably engaged with the arrow chain. The arrow driving assembly is disposed in the driving chamber, and includes a push shaft, an arm assembly, and a push arm, wherein the push shaft is movably disposed in the driving chamber and adjacent to the slider assembly, a moving direction of the push shaft is the same as a moving direction of the slider assembly, an end of the arm assembly is mounted with two ends of the push shaft and extended toward the driving block, and the other end of the arm assembly is pivoted with an end of the push arm, the other end of the push arm is pivoted with the driving chamber, movement of the push shaft makes the arm assembly drive the push arm to longitudinally swing, and the end of the push arm that is pivoted with the arm assembly is longitudinally swung toward the arrow chain, wherein when the push arm is swung, arrows on the arrow chain are pushed to escape and fall on a top surface of the push arm. The string firing assembly is disposed in the driving chamber, and includes a string configured to push the slider assembly to move. A part of the driving assembly is disposed in the driving chamber, another part of the driving assembly is disposed outside the shooting body, the driving assembly includes a track rod assembly and a sliding member assembly, the track rod assembly is fastened in the driving chamber, and a part of the sliding member assembly is assembled with the track rod assembly and movable along the track rod assembly close to or away from the slider assembly, another part of the sliding member assembly that is disposed in the driving chamber further comprises a carrying portion configured to clip the string, and a pushing portion configured to push the push shaft to move.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
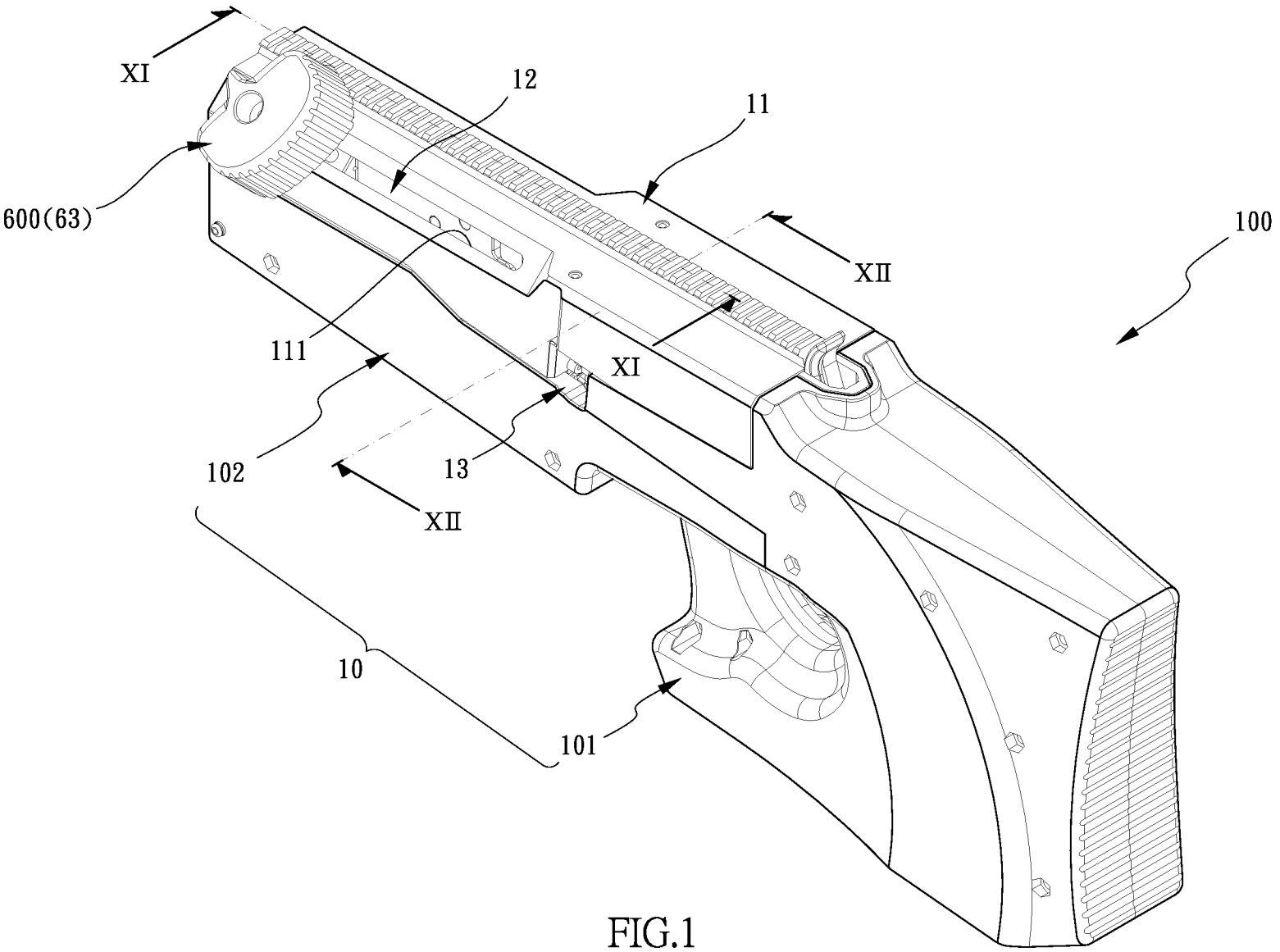
FIG. 1 is a perspective view of a continuous shooting device of the present invention.
Figure 2:
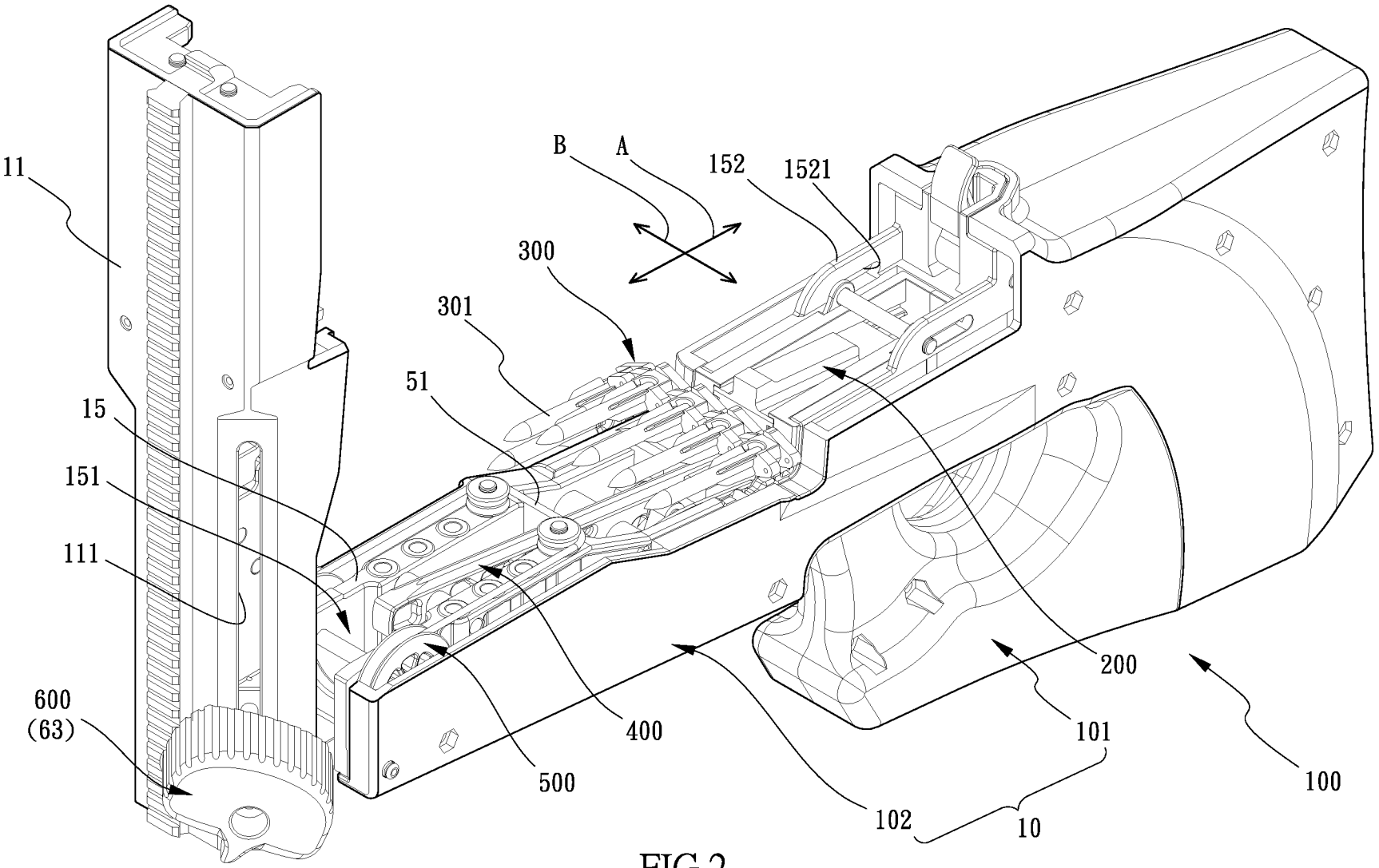
FIG. 2 is a schematic view showing an operation of opening a gun shell by pivotally swinging relative to a main gun shell.
Figure 2A:
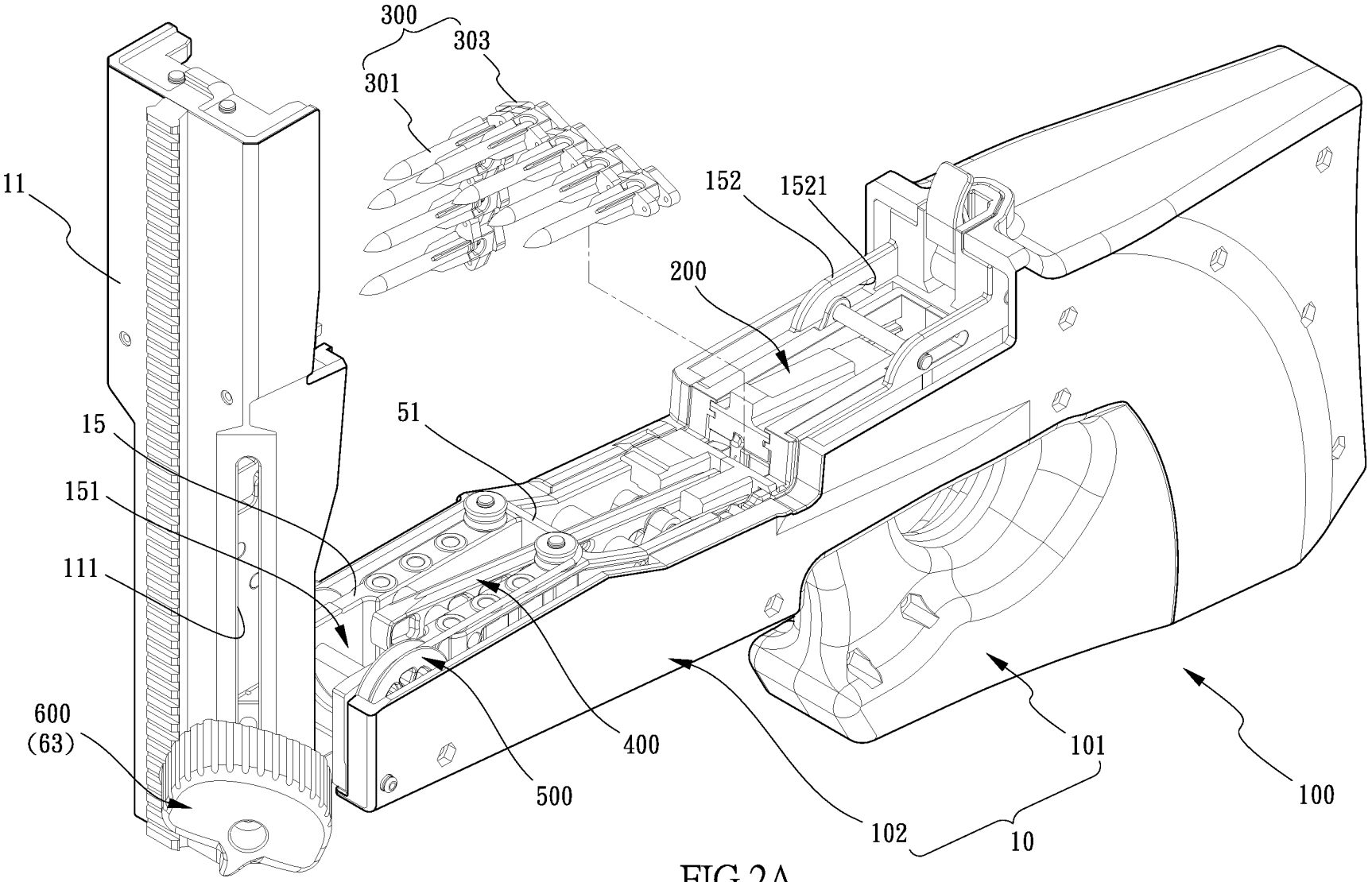
FIG. 2A is an exploded view of the arrow chain and the shooting body of FIG. 2.
Figure 3:
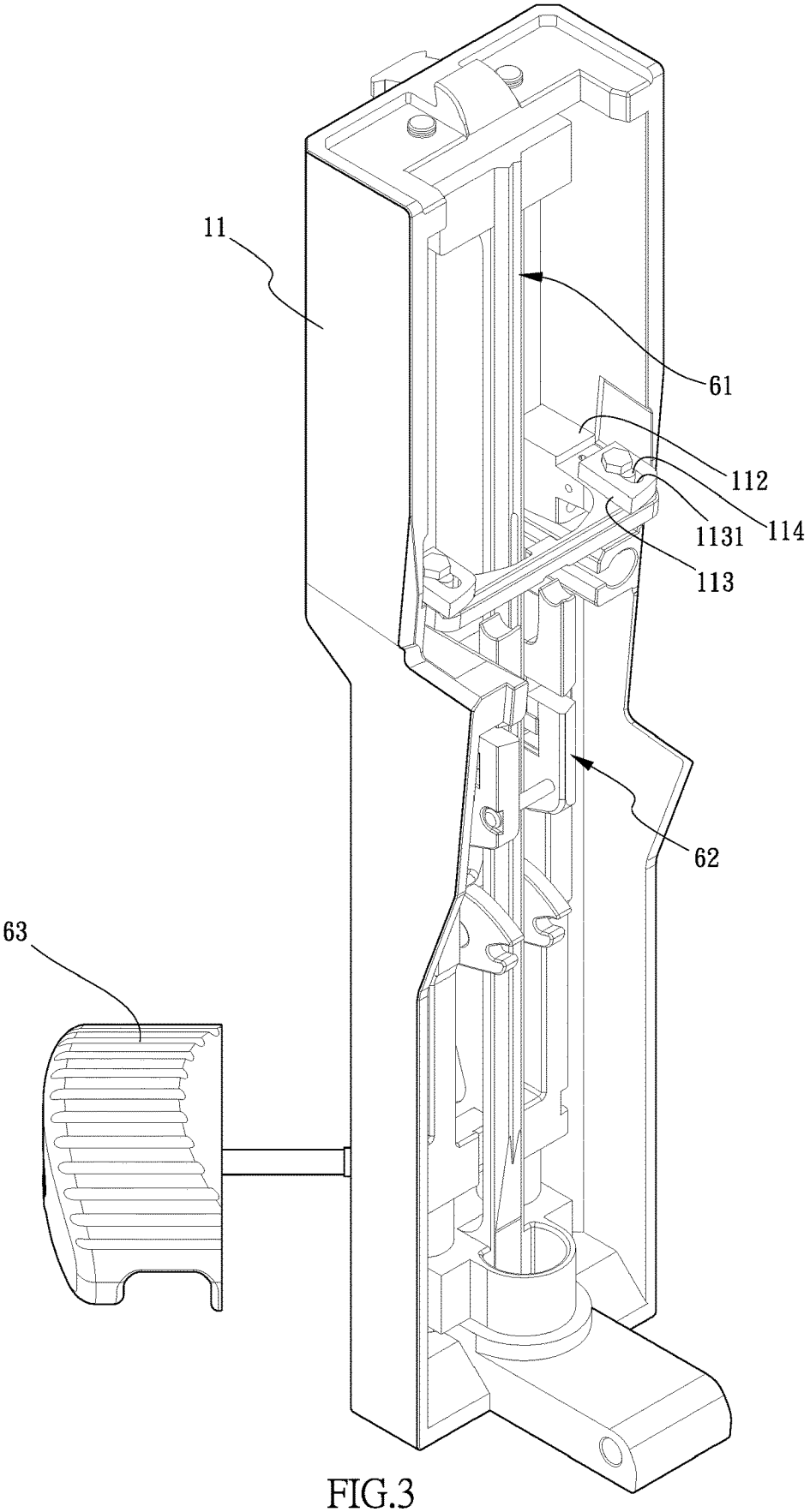
FIG. 3 is a perspective view of a gun shell of the present invention.
Figure 4:
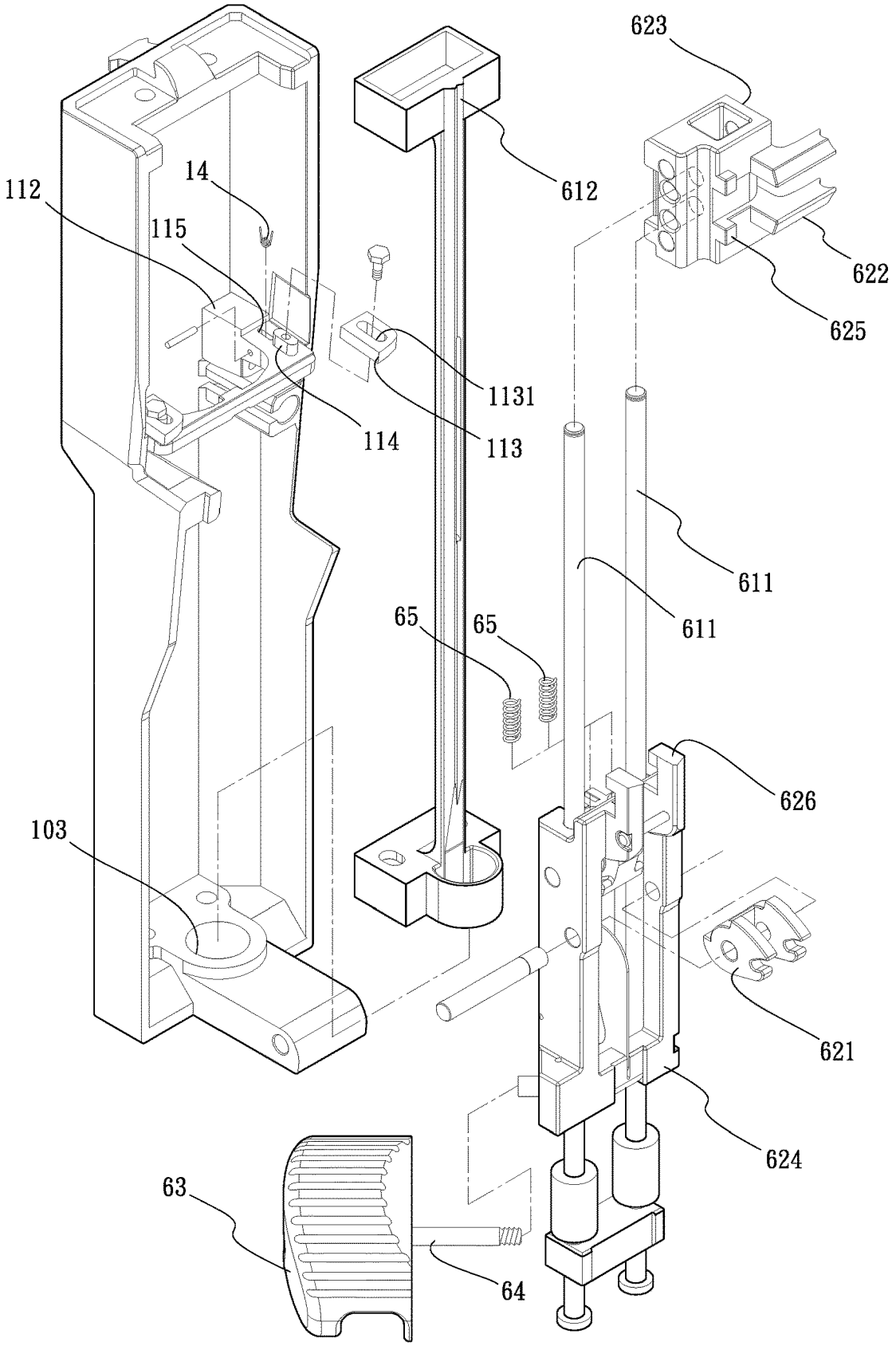
FIG. 4 is a schematic exploded view of a part of FIG. 3.
Figure 5:
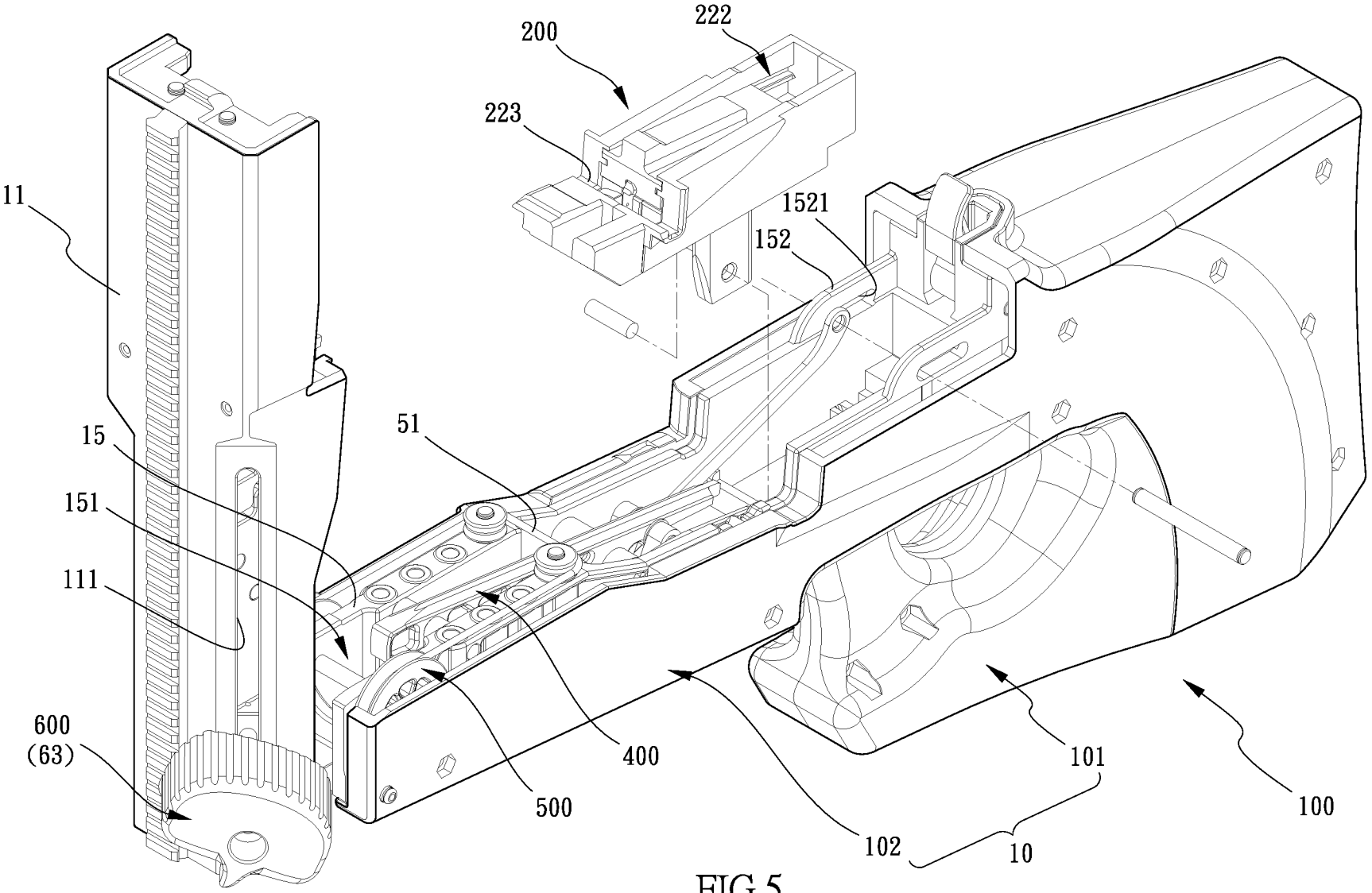
FIG. 5 is a perspective exploded view of a belt chain assembly and a shooting body of the present invention.
Figure 6:
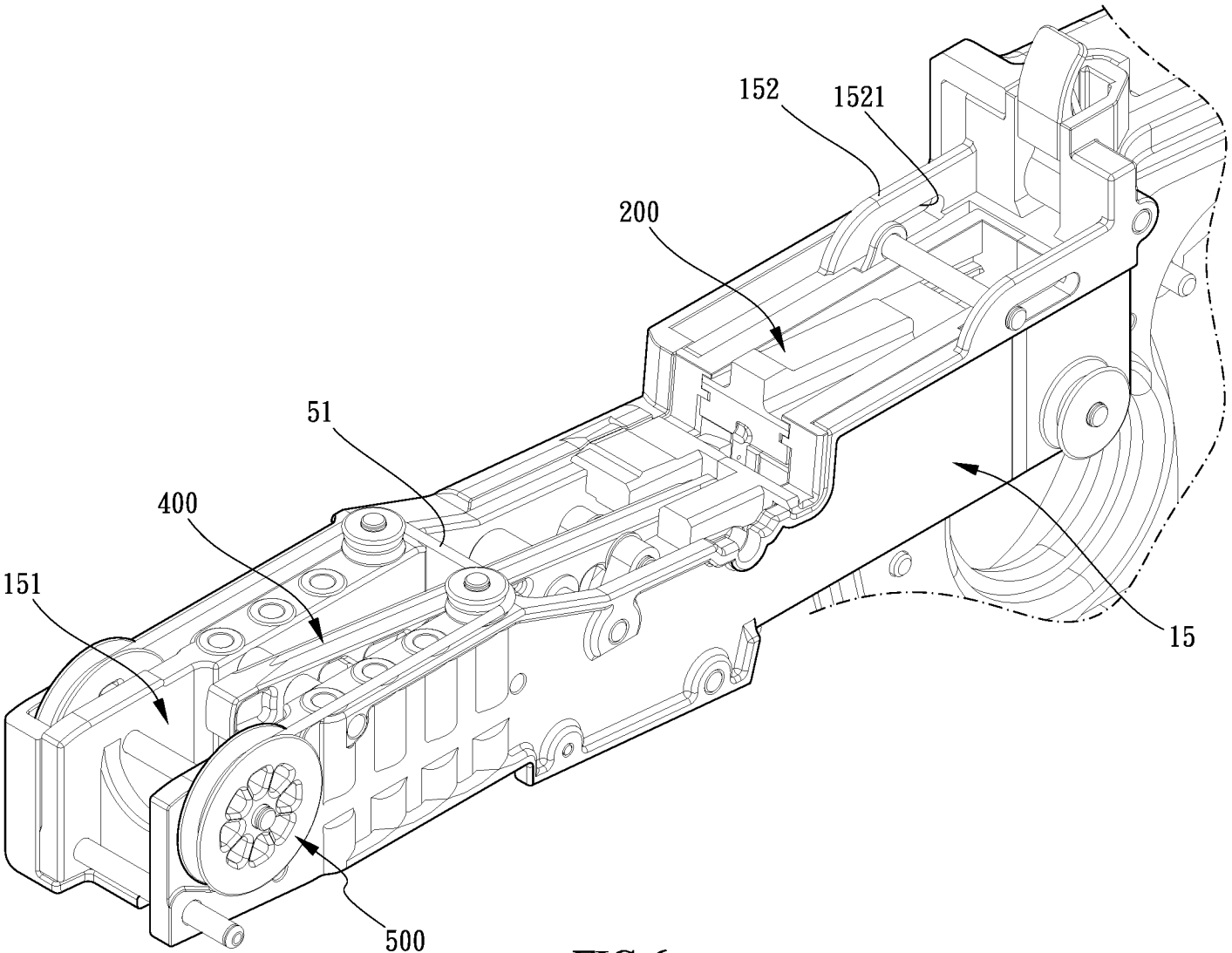
FIG. 6 is an assembly view of an inner mounting frame, an arrow driving assembly, a belt chain assembly and a string firing assembly.
Figure 7:
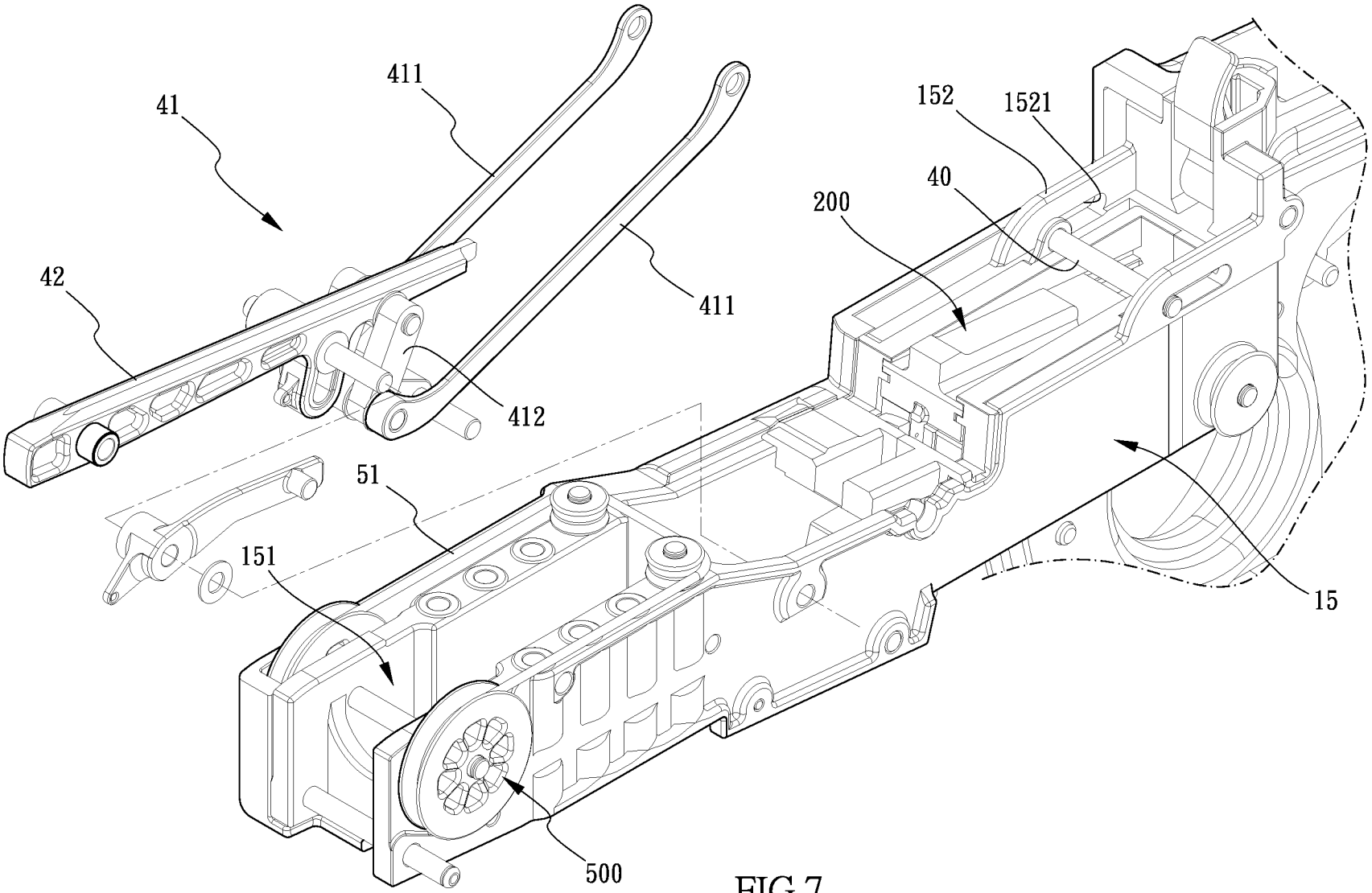
FIG. 7 is a perspective exploded view of the arrow driving assembly and the inner mounting frame of FIG. 6.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

Please refer to FIG. 1 to FIG. 19. As shown in FIG. 1, a continuous shooting device includes a shooting body 100 having a main gun shell 10 and a gun cover 11, the gun cover 11 is configured to cover the main gun shell 10 to form a driving chamber 12, the main gun shell 10 includes a rear support part 101 and a front driving part 102, the rear support part 101 is connected to an end of the front driving part 102, and the gun cover 11 is pivoted with other end of the front driving part 102 and has a shooting hole 103 in connection with the driving chamber 12. The gun cover 11 has a sliding hole 111 cut through a side surface thereof and in connection with a driving chamber 12, and a chain hole 13 cut through a side of the shooting body 100 to other side of the shooting body 100 and in connect with the driving chamber 12. The belt chain assembly 200 is mounted in the driving chamber 12, and located in the front driving part 102 and near the rear support part 101. The belt chain assembly 200 includes a driving block 20 configured to engage with an arrow chain 300, and a slider assembly 21 configured to control a movement of the driving block 20. The driving block 20 corresponds in position to the chain hole 13 and is movably engaged with the arrow chain 300, and the slider assembly 21 can be moved to control the driving block 20 to drive the arrow chain 300 to move from an end opening of the chain hole 13 to the other end opening of the chain hole 13. Diameter sizes of two end openings of the chain hole 13 are different from each other.

The arrow driving assembly 400 is mounted in the driving chamber 12, and located in the front driving part 102 and away from the rear support part 101. The arrow driving assembly 400 includes a push shaft 40, an arm assembly 41, and a push arm 42. The push shaft 40 is movably disposed in the driving chamber 12 and adjacent to the slider assembly 21, and the movement directions of the push shaft 40 and the slider assembly 21 are the same. An end of the arm assembly 41 is mounted with two ends of the push shaft 40 and extended toward the driving block 20, and other end of the arm assembly 41 is pivoted with an end of the push arm 42, and the other end of the push arm 42 is pivoted with the driving chamber 12. The arm assembly 41 includes two long arm members 411 and two short connecting rods 412, an end of each of the two long arm members 411 is pivoted on a corresponding one of two ends of the push shaft 40, another end of each of the two long arm members 411 is pivoted to an end of a corresponding one of the two short connecting rods 412, another end of each of the two short connecting rods 412 is pivoted with a corresponding one of two sides of an end of the push arm 42 that pushes the arrow 301 loaded in the arrow chain 300. A movement of the push shaft 40 is driven by the cooperation between the two long arm members 411 and the two short connecting rods 412, to indirectly drive the push arm 42 to longitudinally swing and push the arrow chain 300 to move, so as to make the loaded arrow 301 escape from the arrow chain 300 and fall on a top surface of the push arm 42.

A part of the string firing assembly 500 is mounted in the front driving part 102 of the driving chamber 12, and a string 51 of the string firing assembly 500 is configured to push the slider assembly 21 to move. A part of the driving assembly 600 is mounted in the driving chamber 12, and a part of the driving assembly 600 is located outside the gun cover 11. The driving assembly 600 includes a track rod assembly 61, a sliding member assembly 62, and an outer control member 63. The track rod assembly 61 is fastened in the driving chamber 12, and a part of the sliding member assembly 62 is assembled with the track rod assembly 61, and the part of the sliding member assembly 62 is movable along the track rod assembly 61 close to or away from the slider assembly 21. Another part of the sliding member assembly 62 disposed in the driving chamber 12 includes a carrying portion 621 configured to clip the string 51, and a pushing portion 622 configured to push the push shaft 40 to move. In addition, the outer control member 63 is disposed outside the gun cover 11 and connected to the sliding member assembly 62 via a connecting rod 64 passing through the sliding hole 111, and the outer control member 63 controls the sliding member assembly 62 to move close to or away from the slider assembly 21 and the push shaft 40.

The gun cover 11 can be pivotally swung relative to the main gun shell 10 and opened, an end of the arrow chain 300 loaded with the arrow 301 is placed into the driving chamber 12 and corresponds in position to the driving block 20, so that the driving block 20 is engaged with the arrow chain 300. After the above-mentioned operations are completed, a user can cover the gun cover 11 on the main gun shell 10. Next, the user pulls the outer control member 63 from an end of the shooting hole 103 to the rear support part 101, the outer control member 63 controls the sliding member assembly 62 to move along the arrangement direction of the track rod assembly 61 toward the slider assembly 21; during the moving process, the carrying portion 621 of the sliding member assembly 62 pulls the string 51, and the string 51 touches the slider assembly 21 under the continuous operations, and the same time the pushing portion 622 also touches the push shaft 40; next, the continuous movement of the outer control member 63 makes the string 51 push the slider assembly 21 to move toward the rear support part 101, so as to make the pushing portion 622 push the push shaft 40 to move toward the rear support part 101; during the moving process of the slider assembly 21, the driving block 20 is controlled to push the arrow chain 300 to move, and the movement of the push shaft 40 indirectly drives an end of the push arm 42 to upwardly swing; during the swinging process of the push arm 42, the driving block 20 controls the movement of the arrow chain 300 and makes the arrow 301 correspond in position to the push arm 42, the push arm 42 pushes the arrow 301 to escape from the arrow chain 300 and fall on the top surface of the push arm 42. After the arrow 301 falls on the top surface of the push arm 42, the string 51 is located behind the arrow 301, when the arrow 301 is fully separated from the arrow chain 300, the user can trigger shooting, so that the string 51 is ejected in the direction of the shooting hole 103 to push against the arrow 301 to move quickly in the direction of the shooting hole 103 and shoot out of the shooting body 100.

Please refer to FIG. 3, FIG. 4, and FIG. 11 to FIG. 14. An end of the connecting rod 64 is inserted through the sliding hole 111 to connect to the sliding member assembly 62, and the other end of the connecting rod 64 is connected to the outer control member 63. The outer control member 63 controls the sliding member assembly 62 to move close to or away from the slider assembly 21 and the push shaft 40. The track rod assembly 61 includes at least one spindle rod 611 and a pressing rod 612. Two spindle rods 611 are taken as an example shown in figures, but the present invention is not limited thereto. The two spindle rods 611 are disposed in the same horizontal level and arranged in interval in the driving chamber 12, and the pressing rod 612 is located between the two spindle rods 611 and at a horizontal level different from that of the spindle rod 611. The pressing rod 612 corresponds to the push arm 42. When the arrow 301 is located on the top surface of the push arm 42, the pressing rod 612 presses against the arrow 301, so that both of the pressing rod 612 and the push arm 42 limit the arrow 301. The sliding member assembly 62 includes a front base member 623 and a rear base member 624, the front base member 623 and the rear base member 624 are slidably mounted on the two spindle rods 611 and movable along the arrangement direction of the spindle rod, the rear base member 624 is close to the shooting hole 103, and the front base member 623 is away from the shooting hole 103. The front base member 623 has a pushing portion 622 formed on an end thereof, and a front engaging portion 625 formed on the other end thereof and engaged with a rear engaging portion 626 of the rear base member 624. The carrying portion 621 is disposed on the rear base member 624. In an embodiment, a spring assembly 65 is disposed between the front base member 623 and the rear base member 624, and the spring assembly 65 controls the front base member 623 and the rear base member 624 to move close to or away from each other by compression or release of elastic force.

The gun cover 11 includes an arch base 112 disposed therein, and two stopper blocks 113. Each stopper block 113 has a long cut groove 1131. When the gun cover 11 is combined with the main gun shell 10, the arch base 112 corresponds in position to the chain hole 13 and the arrow chain 300. The arch base 112 has two protrusions 114 protruded on a side thereof facing the slider assembly 21, and two accommodation slots 115 connected to the two protrusions 114. The two protrusions 114 and the two accommodation slots 115 are disposed on two ends of the arch base 112, respectively. Two ends of each of two torsion springs 14 are elastically abutted with the protrusion 114 and a groove wall of the long cut groove 1131, respectively. Each stopper block 113 is moved by elastic force of the torsion spring 14, so that the stopper block 113 and the driving block 20 drive the arrow chain 300 to move, as shown in FIG. 3, FIG. 4, FIG. 11, and FIG. 13 to FIG. 17.

An inner mounting frame 15 is mounted inside the driving chamber 12, the inner mounting frame 15 has a mounting channel 151 in connection with the driving chamber 12, and two support plates 152 protruded thereon and corresponding in position to the push shaft 40. Each of the two support plates 152 has a track hole 1521 formed thereon, two ends of the push shaft 40 are slidably assembled with the track holes 1521, respectively, the pushing portion 622 pushes the push shaft 40 to move along hole diameters of the track holes 1521, the slider assembly 21 of the belt chain assembly 200 is mounted in the mounting channel 151 and located below the push shaft 40, an end of the push arm 42 that is opposite to the end pushing the arrow 301 is pivoted with an inner wall of the mounting channel 151, the movement of the push shaft 40 drives the two long arm members 411 to move, and the two short connecting rods 412 connected to each other indirectly drive an end of the push arm 42 to push the arrow 301 to escape from the arrow chain 300, as shown in FIG. 2, FIG. 5 to FIG. 7, FIG. 13 and FIG. 14.

The slider assembly 21 includes a first slider 211 and a second slider 212, the first slider 211 and the second slider 212 are slidably disposed in the driving chamber 12, a vertical line A and a horizontal line B are defined for a space inside the driving chamber 12, the first slider 211 is movable along the vertical line A, and the second slider 212 is movable along the horizontal line B. The first slider 211 has at least one oblique groove 2111 recessed on a bottom surface thereof, and the second slider 212 has an oblique guide block 2120 protruded on a top surface thereof and inserted into at least one oblique groove 2111. An end of the second slider 212 that is close to the chain hole 13 is mounted with a driving block 20 configured to engage with the arrow chain 300 when the arrow chain 300 is inserted into the chain hole 13. A base 22 is mounted in the driving chamber 12 and near the rear support part 101, and the base 22 includes two covers 221. The two covers 221 are combined to form an accommodation groove 222, and the accommodation groove 222 has track protrusions 226 protruded on inner walls of two sides thereof, respectively, the track protrusions 226 are disposed along the vertical line A, and the first slider 211 has track grooves 2110 recessed on two sides thereof and configured to slidably connect to the track protrusions 226, respectively. Each track protrusion 226 is inserted into a corresponding one of the track grooves 2110, and the first slider 211 is movable via the track grooves 2110 along the arrangement direction of the track protrusions 226, the base 22 has a chain mounting groove 223 cut through an end thereof near the chain hole 13, and a driving hole 224 cut through a groove bottom of the chain mounting groove 223. The driving block 20 is disposed in the driving hole 224 and movable along the horizontal line B. The end of the driving block 20 that is engaged with the arrow chain 300 is exposed out of the driving hole 224, as shown in FIG. 5, FIG. 8, FIG. 9, and FIG. 15 to FIG. 19.

Figure 8:
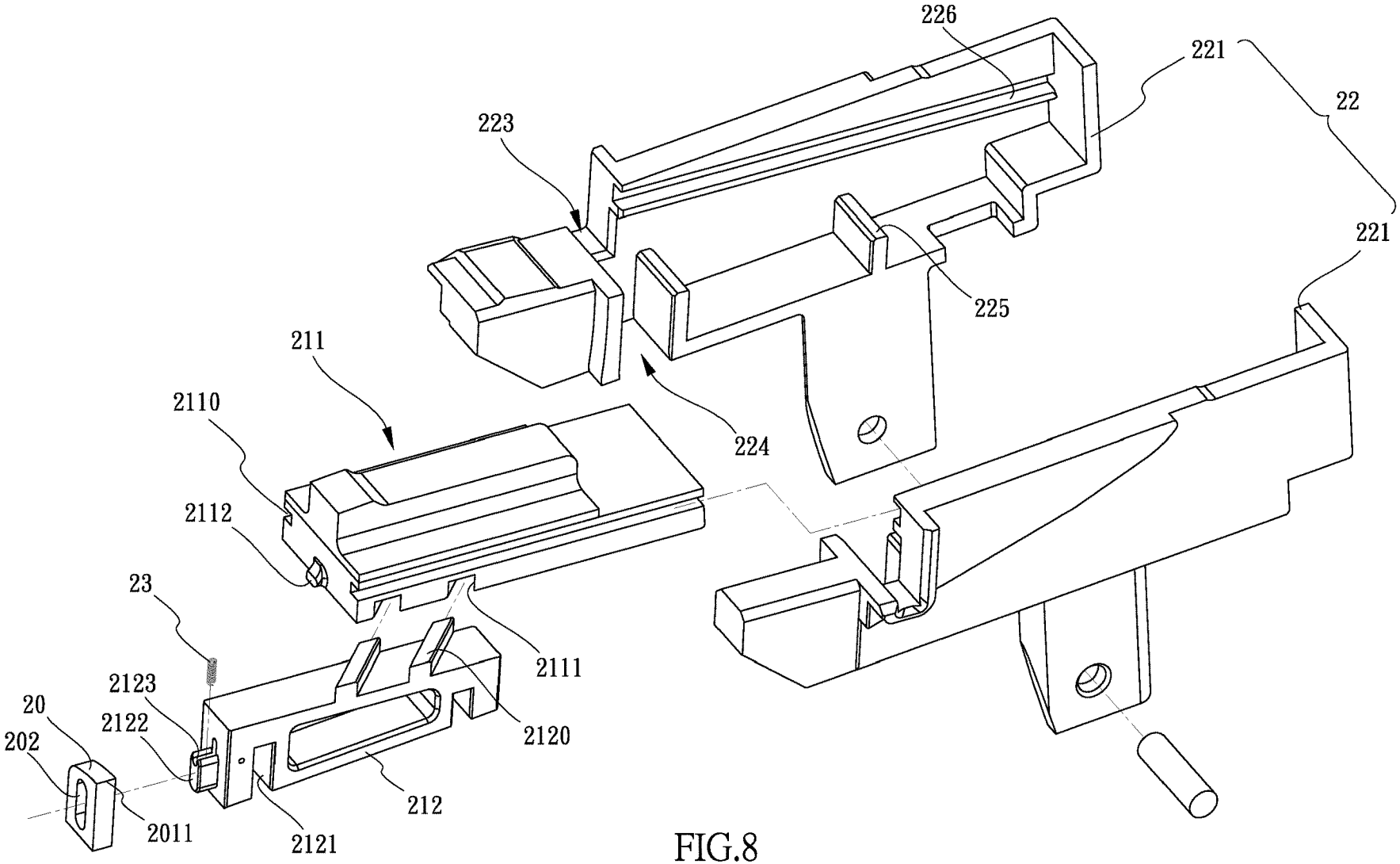
FIG. 8 is a perspective exploded view of a slider assembly and a driving block of the present invention.
Figure 9:
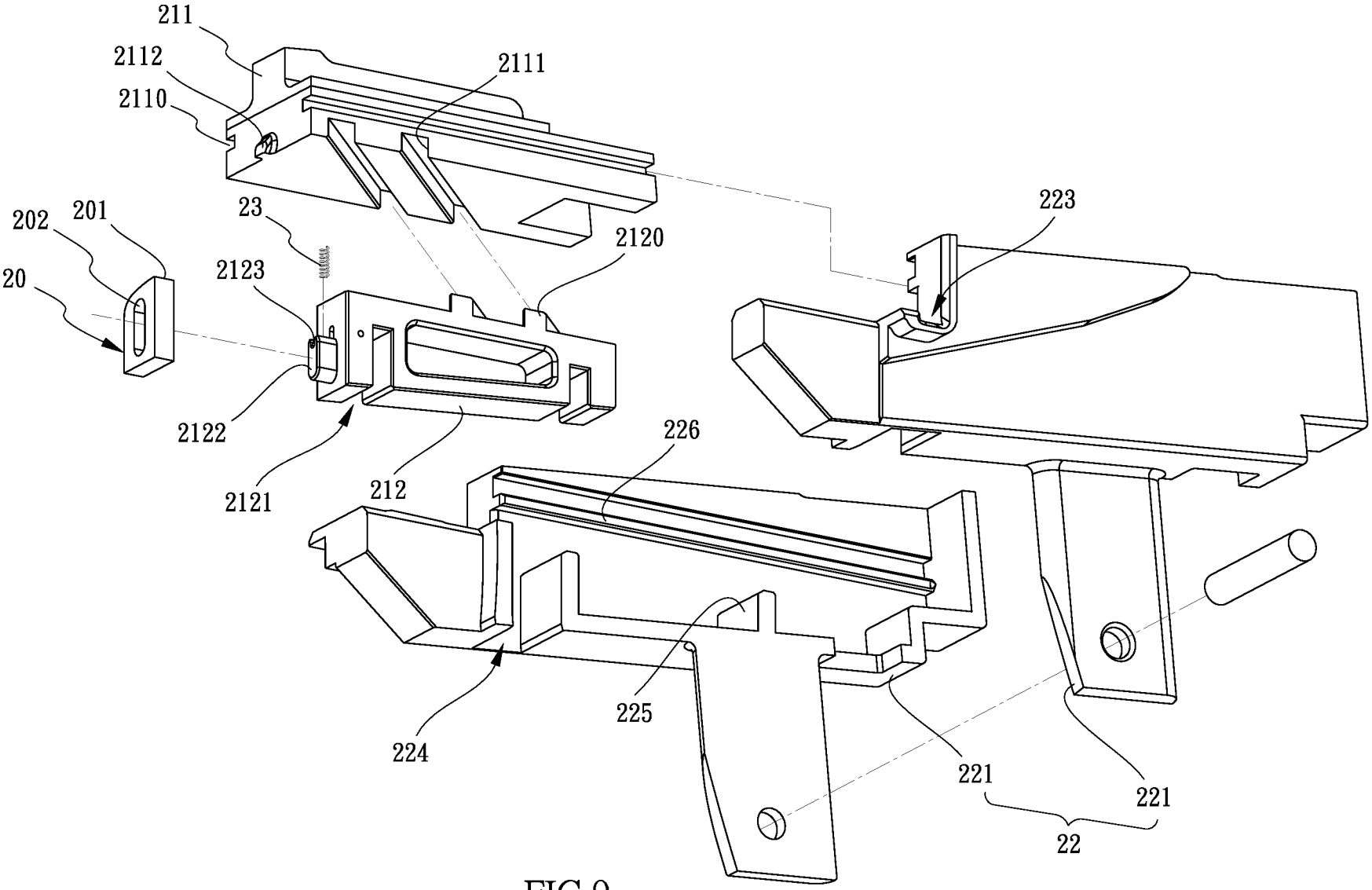
FIG. 9 is a perspective exploded view of FIG. 8 when viewed from another angle.
Figure 10:
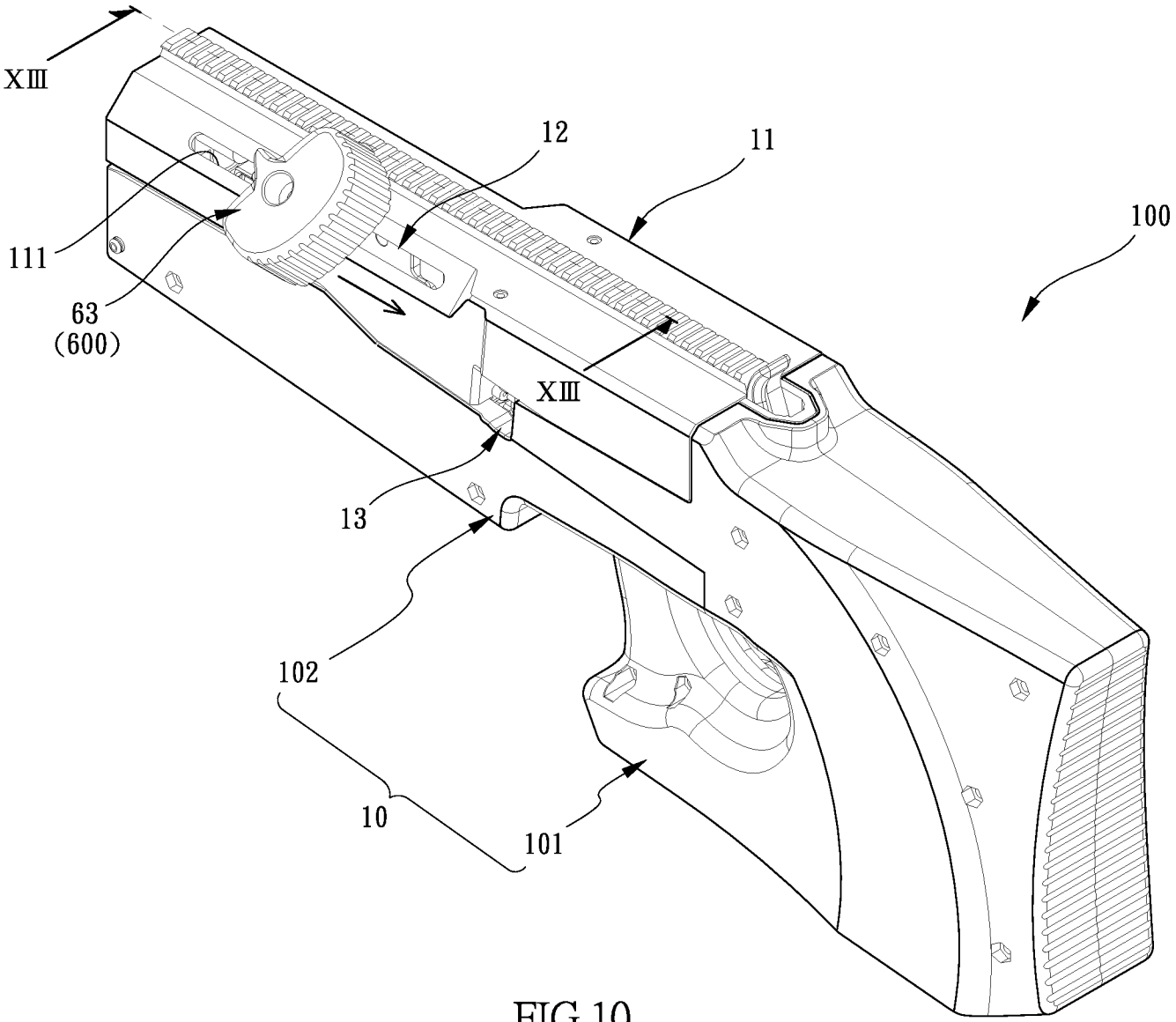
FIG. 10 is a perspective schematic view showing an operation of moving an outer control member of the present invention.
Figure 11:
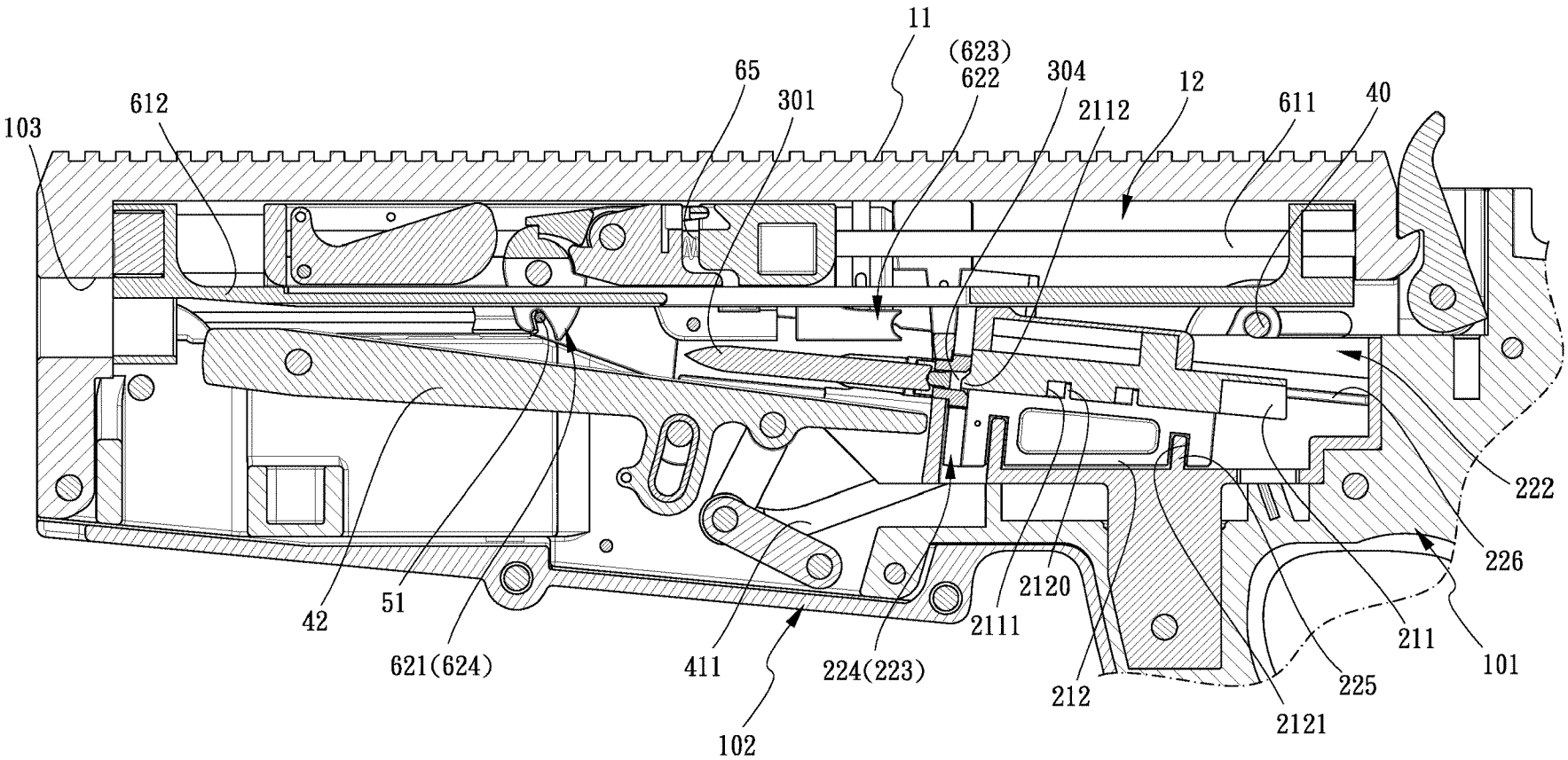
FIG. 11 is a schematic cross-sectional view of FIG. 1 taken along XI-XI.
Figure 12:
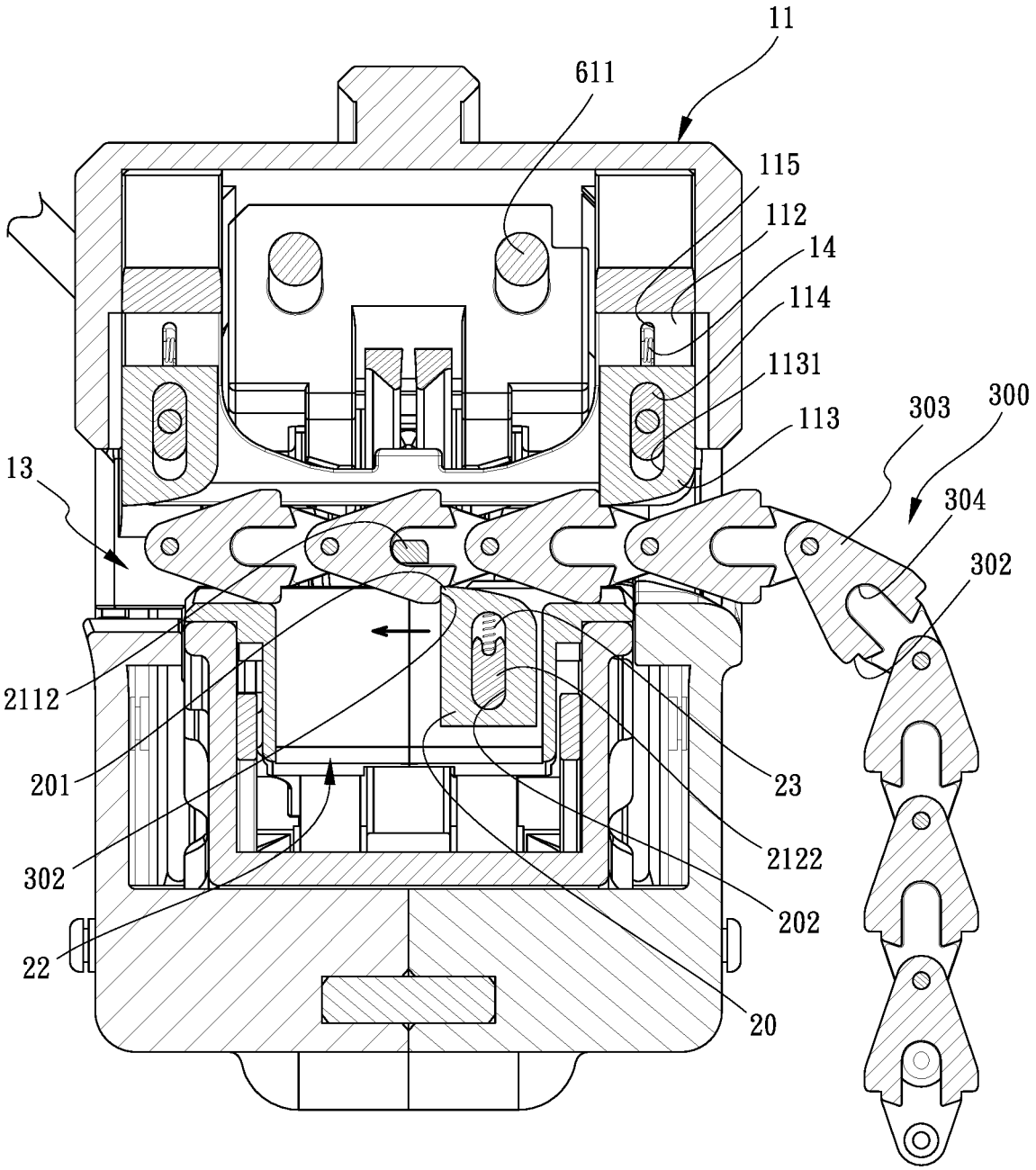
FIG. 12 is a schematic cross-sectional view of FIG. 1 taken along XII-XII.
Figure 13:
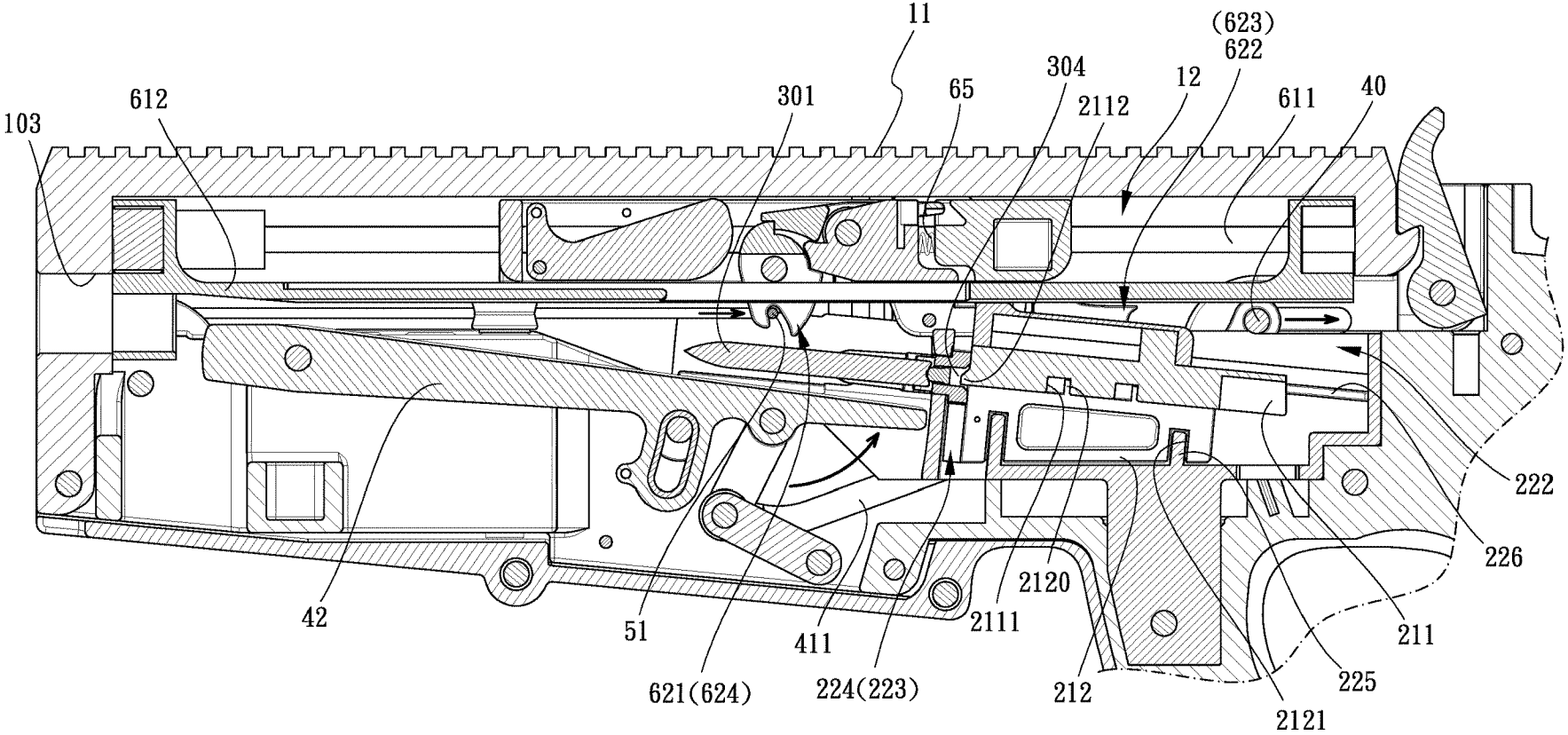
FIG. 13 is a schematic cross-sectional view of FIG. 10 taken along XIII-XIII.
Figure 14:
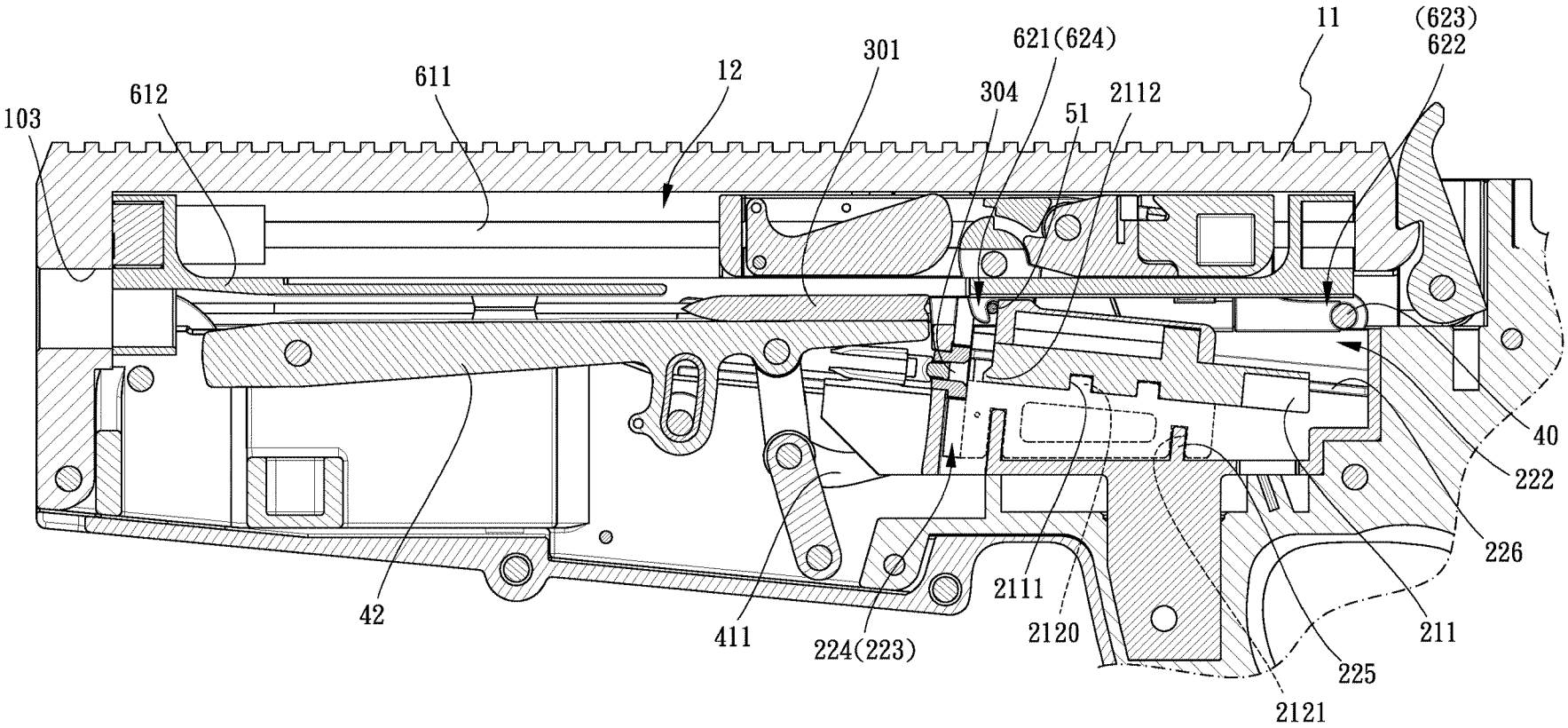
FIG. 14 is a schematic view showing an operation that a string pushes a slider assembly, a pushing portion pushes a push shaft to move, and a push arm is upwardly swung to push an arrow to escape from an arrow chain in FIG. 13, according to the present invention.
Figure 15:
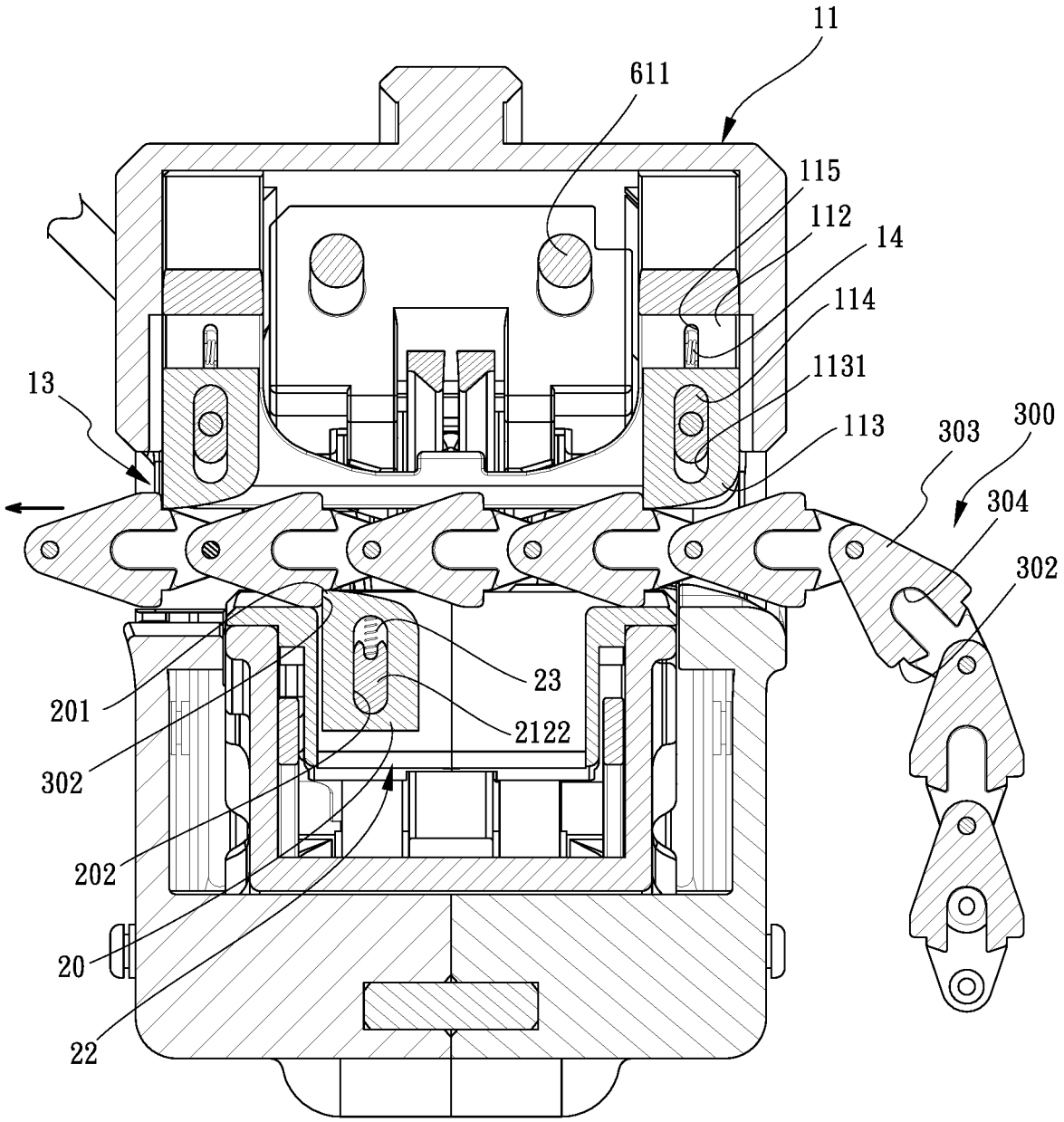
FIG. 15 to FIG. 17 are schematic views showing continuous operations that the driving block drives an arrow chain to move in FIG. 12, according to the present invention.
Figure 16:
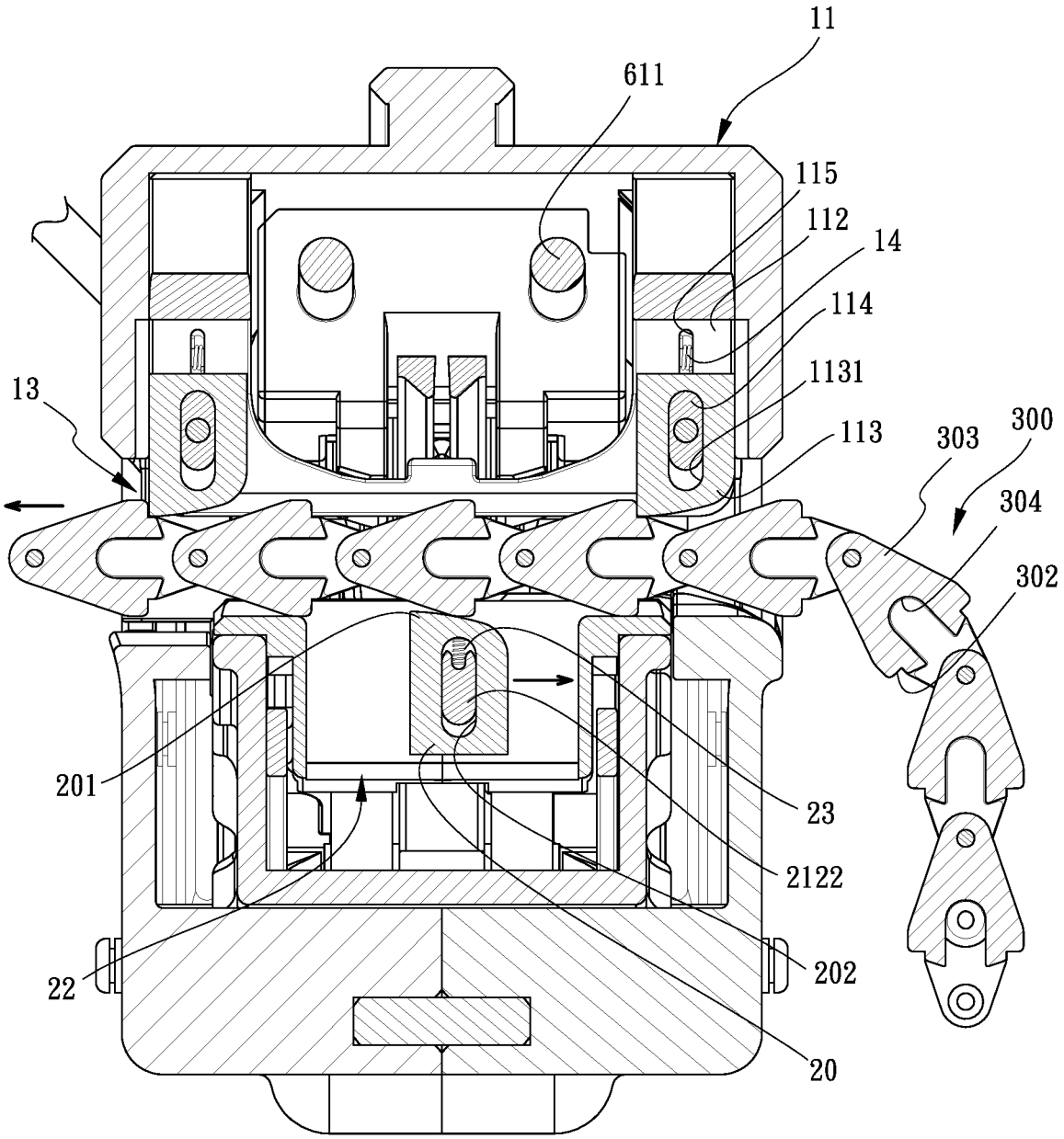
Figure 17:
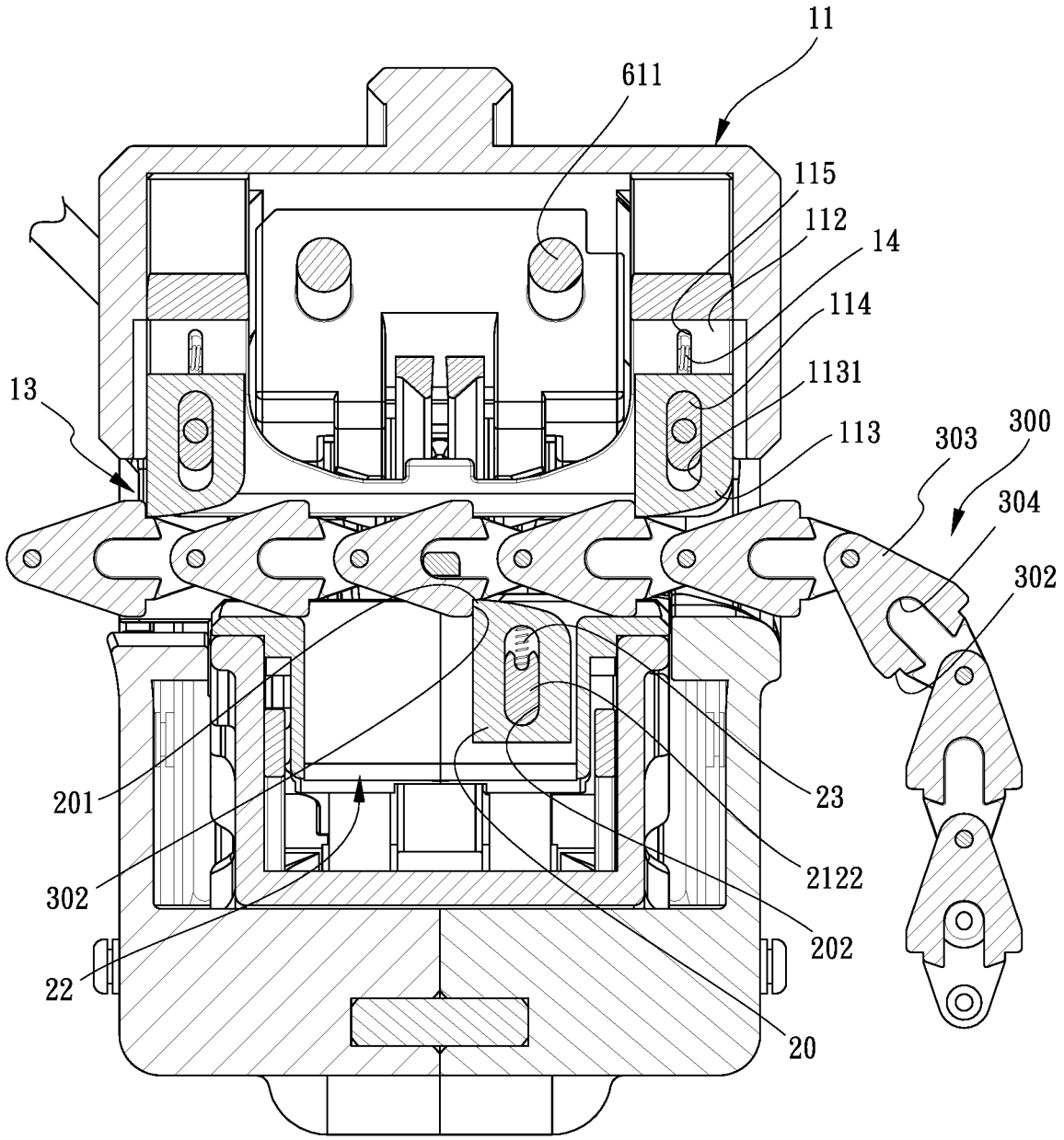
Figure 18:
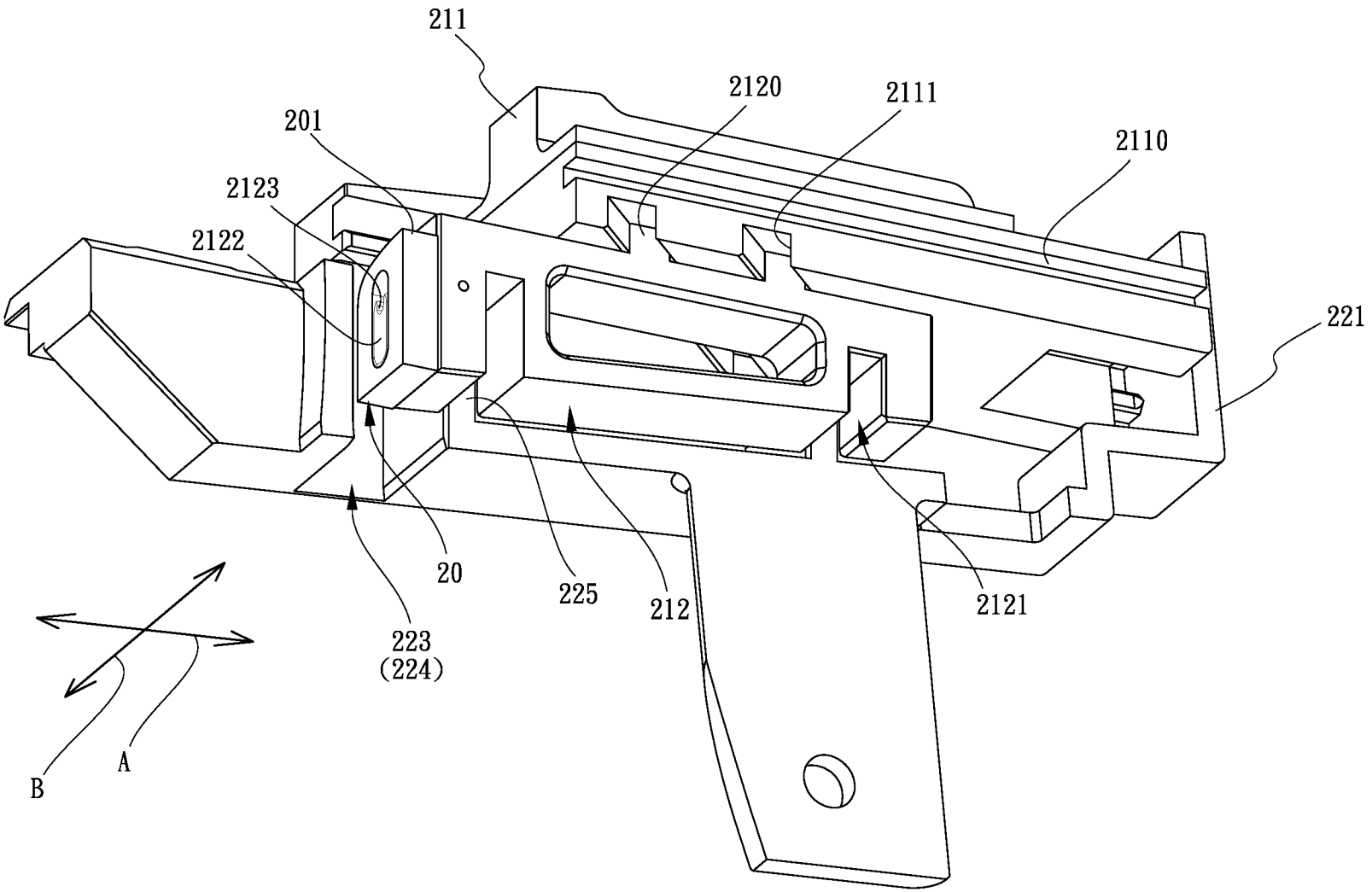
FIG. 18 and FIG. 19 are schematic views showing operations of moving a slider assembly in a base, according to the present invention.
Figure 19:
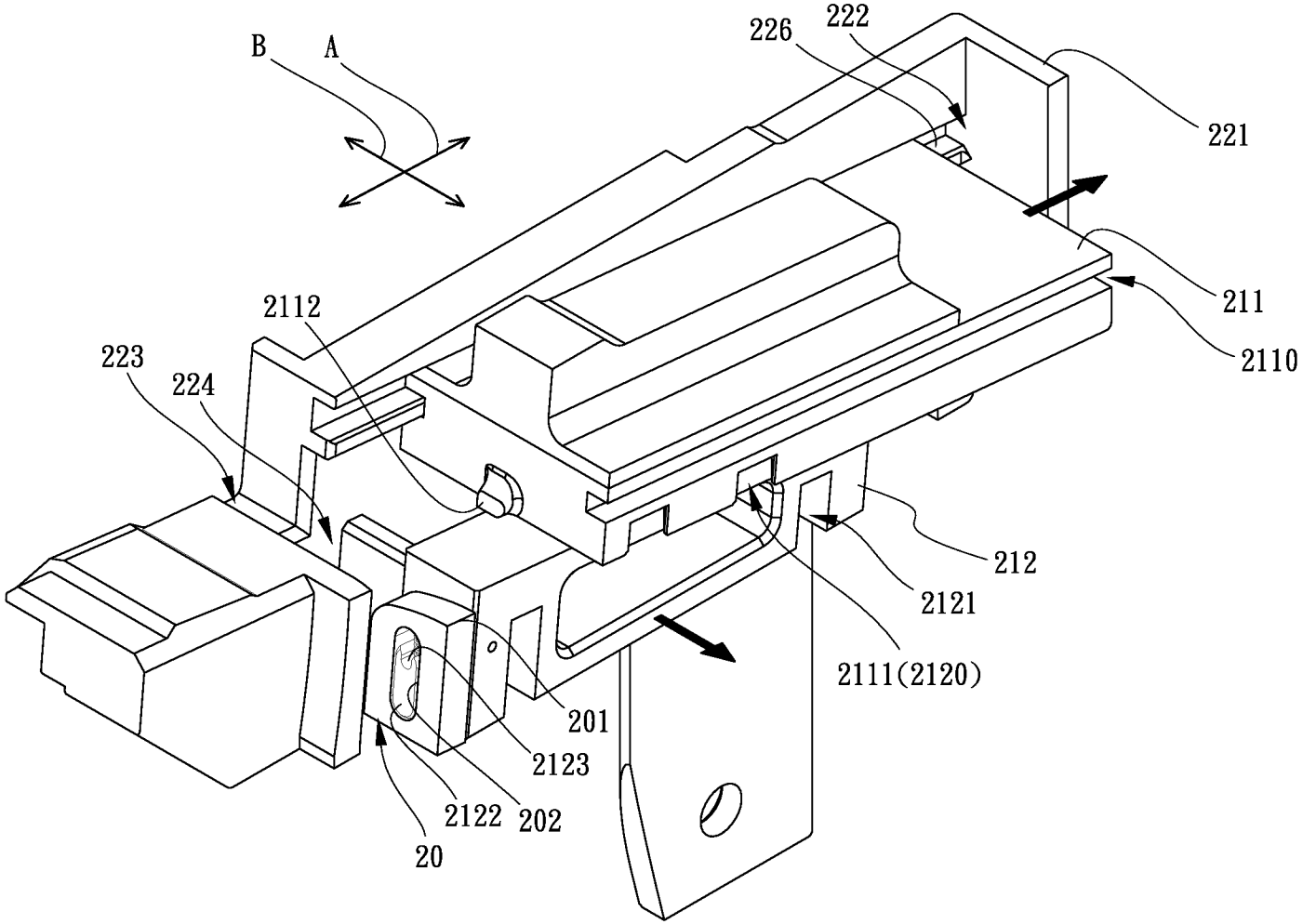

Please refer to FIG. 15 to FIG. 19, at least one protrusion plate 225 is disposed on a bottom surface of the accommodation groove 222 and extended toward the groove opening of the accommodation groove 222. The at least one protrusion plate 225 is disposed along the horizontal line B, and the second slider 212 has an insertion slot 2121 formed on a bottom surface thereof, the at least one protrusion plate 225 is inserted in the insertion slot 2121, the second slider 212 is movable along the arrangement direction of the at least one protrusion plate 225. As shown in FIG. 9, the oblique grooves 2111 formed on the bottom surface of the first slider 211 are disposed in oblique directions along from down to up, and from right to left; as shown in FIG. 8, the oblique guide blocks 2120 of the second slider 212 are disposed in oblique directions along from down to up, and from left to right; that is, movements of the first slider 211 and the movement of the second slider 212 are misaligned in FIG. 8 and FIG. 9.

The arrow chain 300 has fastening grooves 304 formed on the chain blocks 303, respectively. Please refer to FIG. 10 to FIG. 19. The first slider 211 has a stopper protrusion 2112 protruded on an end surface thereof facing the arrow chain 300; after the arrow chain 300 is loaded into the chain hole 13, an end of the driving block 20 is engaged with the arrow chain 300, the stopper protrusion 2112 is also inserted into one of the fastening grooves 304 on the arrow chain 300, so that an additional restriction is formed between the arrow chain 300 and the driving block 20.

The second slider 212 has an insertion block 2122 protruded on a side thereof corresponding to the driving block 20, and a first curved groove 2123 recessed on a top of the insertion block 2122, the driving block 20 has a long sliding hole 202 corresponding in position to the insertion block 2122, the insertion block 2122 is inserted in the long sliding hole 202, an elastic device 23 is disposed between the hole wall of the long sliding hole 202 and the first curved groove 2123, and two ends of the elastic device 23 are elastically abutted with the hole wall of the long sliding hole 202 and the groove wall of the first curved groove 212, respectively, as shown in FIG. 15 to FIG. 19.

The present invention disclosed herein has been described by means of specific embodiments. However, numerous modifications, variations and enhancements can be made thereto by those skilled in the art without departing from the spirit and scope of the disclosure

What is claimed is:

1. A continuous shooting device with a controllable arrow chain structure, wherein the continuous shooting device comprises:

a shooting body having a driving chamber disposed therein, and a chain hole cut through a side of the shooting body to other side of the shooting body to connect the driving chamber;

a belt chain assembly disposed in the driving chamber, and comprising a driving block configured to engage with an arrow chain, and a slider assembly configured to control movement of the driving block, wherein the driving block corresponds in position to the chain hole and is movably engaged with the arrow chain;

an arrow driving assembly disposed in the driving chamber, and comprising a push shaft, an arm assembly and a push arm, wherein the push shaft is movably disposed in the driving chamber and adjacent to the slider assembly, a moving direction of the push shaft is the same as a moving direction of the slider assembly, an end of the arm assembly is mounted with two ends of the push shaft and extended toward the driving block, and the other end of the arm assembly is pivoted with an end of the push arm, the other end of the push arm is pivoted with the driving chamber, movement of the push shaft makes the arm assembly drive the push arm to longitudinally swing, and the end of the push arm that is pivoted with the arm assembly is longitudinally swung toward the arrow chain, wherein when the push arm is swung, arrows on the arrow chain are pushed to escape and fall on a top surface of the push arm;

a string firing assembly, disposed in the driving chamber, and comprising a string configured to push the slider assembly to move; and a driving assembly, wherein a part of the driving assembly is disposed in the driving chamber, another part of the driving assembly is disposed outside the shooting body, the driving assembly comprises a track rod assembly and a sliding member assembly, the track rod assembly is fastened in the driving chamber, a part of the sliding member assembly is assembled with the track rod assembly and movable along the track rod assembly close to or away from the slider assembly, another part of the sliding member assembly that is disposed in the driving chamber further comprises a carrying portion configured to clip the string, and a pushing portion configured to push the push shaft to move.

2. The continuous shooting device with controllable arrow chain structure according to claim 1, wherein the shooting body further comprises a main gun shell and a gun cover, the main gun shell has a rear support part and a front driving part, the rear support part is connected to an end of the front driving part, the gun cover is pivoted with another end of the front driving part, the gun cover has a shooting hole, wherein when the main gun shell is covered with the gun cover, the main gun shell and the gun cover form the driving chamber, and the driving chamber in connection with the shooting hole, wherein the gun cover has a sliding hole cut through a side thereof, and another part of the driving assembly is located in the sliding hole and slidable along the sliding hole.

3. The continuous shooting device with controllable arrow chain structure according to claim 2, wherein the driving assembly further comprises an outer control member disposed outside the gun cover, and connected to the sliding member assembly by a connecting rod passing the sliding hole, the outer control member controls the sliding member assembly to move close to or away from the slider assembly and the push shaft.

4. The continuous shooting device with controllable arrow chain structure according to claim 2, wherein the track rod assembly further comprises at least one spindle rod and a pressing rod, the pressing rod corresponds to the push arm, and when the arrow is disposed on a top surface of the push arm, the pressing rod presses against the arrow and limits the arrow from shaking;

wherein the sliding member assembly further comprises a front base member and a rear base member, the front base member and the rear base member are slidably mounted on at least one spindle rod and movable along the at least one spindle rod, the rear base member is close to the shooting hole, the front base member is away from the shooting hole, an end of the front base member has the pushing portion, the other end of the front base member has a front engaging portion engaged with a rear engaging portion of the rear base member, the carrying portion is disposed on the rear base member, a spring assembly is disposed between the front base member and the rear base member, and the spring assembly is configured to control the front base member and the rear base member to move close to or away from each other by compression or release of an elastic force.

5. The continuous shooting device with controllable arrow chain structure according to claim 2, wherein the gun cover comprises an arch base and two stopper blocks, when the gun cover is combined with the main gun shell, the arch base corresponds in position to the chain hole and the arrow chain, the arch base comprises two protrusions protruded on a side thereof facing the slider assembly, and two accommodation slots connected to the two protrusions, wherein the two protrusions are disposed on two ends of the arch base, respectively, the two accommodation slots are disposed on the two ends of the arch base, respectively, two torsion springs are disposed inside the two accommodation slots, respectively, each of the two stopper blocks has a long cut groove, each of the two protrusions is inserted into and assembled with a corresponding one of the long cut grooves, two ends of each of the two torsion springs are elastically abutted with a corresponding one of the two protrusions and a groove wall of a corresponding one of the long cut grooves, respectively, wherein the two stopper blocks are moved by elastic movements of the two torsion springs to drive the arrow chain to move in cooperation with the driving block.

6. The continuous shooting device with controllable arrow chain structure according to claim 1, further comprising an inner mounting frame disposed in the driving chamber, wherein a part of the belt chain assembly and a part of the arrow driving assembly are mounted with the inner mounting frame, the inner mounting frame has a mounting channel in connection with the driving chamber, the inner mounting frame has two support plates protruded thereon and corresponding in position to the push shaft, each of the two support plates has a track hole formed thereon, two ends of the push shaft are slidably assembled with the track holes, respectively, and the pushing portion pushes the push shaft to move along hole diameters of the track holes, the slider assembly of the belt chain assembly is mounted in the mounting channel and located below the push shaft.

7. The continuous shooting device with controllable arrow chain structure according to claim 6, wherein the arm assembly comprises two long arm members and two short connecting rods, an end of each of the two long arm members is pivoted on a corresponding one of two ends of the push shaft, another end of each of the two long arm members is pivoted to an end of a corresponding one of the two short connecting rods, another end of each of the two short connecting rods is pivoted with a corresponding one of two sides of an end of the push arm that pushes the arrow, another end of the push arm opposite to the end that pushes the arrow is pivoted with an inner wall of the mounting channel, a movement of the push shaft drives the two long arm members to move, and the two short connecting rods connected together indirectly drive an end of the push arm to push the arrow to escape from the arrow chain, and the escaped arrow falls on the top surface of the push arm.

8. The continuous shooting device with controllable arrow chain structure according to claim 1, wherein the slider assembly further comprises a first slider and a second slider, the first slider and the second slider are slidably disposed in the driving chamber, a vertical line and a horizontal line are defined for a space inside the driving chamber, the first slider is movable along the vertical line, the second slider is movable along the horizontal line, the first slider has at least one oblique groove recessed on a bottom surface thereof, and the second slider has an oblique guide block protruded on a top surface thereof and configured to insert into the at least one oblique groove, wherein an end of the second slider that is close to the chain hole is mounted with a driving block, wherein the driving block is engaged with the arrow chain when the arrow chain is inserted into the chain hole.

9. The continuous shooting device with controllable arrow chain structure according to claim 8, wherein the belt chain assembly further comprises a base mounted in the driving chamber, and the base comprises two covers, the two covers are combined to form an accommodation groove, and the accommodation groove has track protrusions protruded on inner walls of two sides thereof, respectively, the track protrusions are disposed along the vertical line, the first slider has track grooves recessed on two sides thereof and configured to slidably connect to the track protrusions, respectively, the track protrusions are inserted into the track grooves, respectively, and the first slider is moved via the track grooves along an arrangement direction of the track protrusions.

10. The continuous shooting device with controllable arrow chain structure according to claim 9, wherein the accommodation groove has at least one protrusion plate disposed on a bottom surface thereof and extended toward a groove opening thereof, an arrangement direction of the at least one protrusion plate corresponds to a direction of the horizontal line, the second slider has an insertion slot formed on a bottom surface thereof, the at least one protrusion plate is inserted in the insertion slot, and the second slider is moved along the arrangement direction of the at least one protrusion plate, wherein the first slider has a stopper protrusion protruded on an end thereof facing the arrow chain, wherein when the driving block is engaged with the arrow chain, the stopper protrusion is inserted into one of fastening grooves of the arrow chain.

* * * * *